United States Patent [19]

Gatsis

[11] 4,394,248

[45] Jul. 19, 1983

[54] COAL LIQUEFACTION PROCESS

[75] Inventor: John G. Gatsis, Des Plaines, Ill.

[73] Assignee: UOP Inc., Des Plaines, Ill.

[21] Appl. No.: 303,665

[22] Filed: Sep. 18, 1981

[51] Int. Cl.[3] ..... C10G 1/06
[52] U.S. Cl. ..... 208/10
[58] Field of Search ..... 208/10

[56] References Cited

U.S. PATENT DOCUMENTS

| | | | |
|---|---|---|---|
| 4,149,959 | 4/1979 | Bearden, Jr. et al. | 208/10 X |
| 4,219,403 | 8/1980 | Nakoko et al. | 208/10 |
| 4,298,454 | 11/1981 | Aldride et al. | 208/10 |
| 4,338,183 | 7/1982 | Gatsis | 208/10 |

FOREIGN PATENT DOCUMENTS

| | | | |
|---|---|---|---|
| 2729508 | 1/1978 | Fed. Rep. of Germany | 208/10 |
| 2444827 | 4/1976 | Fed. Rep. of Germany | 208/10 |
| 2713026 | 5/1978 | Fed. Rep. of Germany | 208/10 |

*Primary Examiner*—Delbert E. Gantz
*Assistant Examiner*—William G. Wright
*Attorney, Agent, or Firm*—James R. Hoatson, Jr.; John G. Cutts, Jr.; William H. Page, II

[57] ABSTRACT

A process for liquefying coal which comprises contacting coal and solvent in the presence of a residual oil containing asphaltenes and at least one finely divided, unsupported metal sulfide and recovering valuable liquid hydrocarbon products from the resulting liquid coal extract.

21 Claims, No Drawings

COAL LIQUEFACTION PROCESS

BACKGROUND OF THE INVENTION

This invention relates to solvent extraction. It also relates to a method for liquefying coal using a selective solvent. It particularly relates to a process for obtaining valuable liquid hydrocarbons from particulate coal utilizing the steps of solvation and hydrogenation.

It has long been known that hydrocarbon gases, liquids, pitch and chemicals may be obtained in useful form from coal which is mined from the earth. Usually, the prior art has employed destructive distillation or other gasification processes for the conversion of coal into these more valuable and useful products. Recently, the prior art has developed a high pressure hydrogenation of coal technique to effectuate such conversion. Still more recently, methods involving solvent extraction techniques have been developed for obtaining useful fuels and chemicals from coal whereby the coal is contacted with a selective solvent which acts as a hydrogen-donor for supplying sufficient hydrogen to the coal to aid in converting it into a liquid state. Following the solvent extraction step the prior art schemes have utilized various recovery procedures, such as hydrogenation of the liquid coal extract, for increasing its value and utility together with retorting or coking of the residual materials obtained from the solvent extraction step to still further convert these coal derived products into more commercially valuable products.

Furthermore, the prior art has taught the use of various catalysts to enhance the recovery of hydrocarbons from coal liquefaction. In previous procedures, there has been a remaining persistent problem and that is the problem of recovering the catalyst from the hydrocarbon product and the residual ash. Because of the cost of catalysts, it has been thought that for a coal liquefaction process to be economical, the catalyst must be recovered and subsequently recycled. An alternative would be to utilize a once-through or throw-away catalyst, which would only have to be separated from the hydrocarbon product and could be discarded with the residual ash.

Therefore, for these and other reasons, none of the aforementioned prior art procedures have been sufficiently commercially attractive or feasible to warrant widespread commercial exploitation of converting coal into valuable liquid products. Generally, the deficiencies in the prior art schemes have not only involved capital investment problems and lack of suitable and economical catalyst systems, but have also involved liquid product quality and quantity problems which have yet to be solved in an economical and facile manner.

Since it is clear to those skilled in the art that the vast mineral resources of bituminous coal represent an extremely important supply of energy and an extremely important source of raw materials for valuable chemicals, it would be desirable to improve upon the prior art techniques, particularly the solvent extraction step in order to reduce the cost of obtaining high quality petroleum-type product from coal.

BRIEF SUMMARY OF THE INVENTION

Therefore, it is an object of this invention to provide a process for the liquefaction of coal whereby valuable liquid hydrocarbons are obtained therefrom.

It is a specific object of this invention to provide an improved process for subjecting pulverized coal to solvent extraction for the conversion thereof into valuable liquid hydrocarbons.

It is a particular object of this invention to provide an improved process for producing hydrogen-enriched hydrocarbonaceous products from coal in a more facile and economical manner.

Furthermore, it is an object of the present invention to provide an improved process for liquefying coal which comprises contacting coal and solvent in the presence of a residual oil containing asphaltenes and at least one finely divided, unsupported metal sulfide and recovering valuable liquid hydrocarbon products from the resulting liquid coal extract.

DETAILED DESCRIPTION OF THE INVENTION

Thus, it is to be noted from the summary of the present invention presented hereinabove that the benefits to be derived from the practice thereof are predicated on the presence of a residual oil containing asphaltenes and at least one finely divided, unsupported metal sulfide during the solvent extraction step. It is believed that one of the reasons the practice of this invention produces such desirable results is that the residual oil improves the total conversion of the coal extract, rendering the ash more readily filterable and producing a liquid coal extract having a higher hydrogen content than would otherwise be obtained.

The coal suitable for use in the practice of the present inventive process is of the bituminous type, such as Pittsburg Seam Coal. More preferably, however, the bituminous coal is a high volatile content coal having a volatile content greater than about 20% by weight of m.a.f. coal (moisture and ash-free coal). Although the invention will be described with reference to the conversion of bituminous coal to valuable liquid hydrocarbons, it is within the concept of the present invention to apply the inventive process to sub-bituminous coal, lignite, and other solid carbonaceous materials of natural origin. For convenience, therefore, the term "coal" is intended to include all materials with the class consisting of bituminous coal, sub-bituminous coal, lignite, and other solid carbonacous materials of natural origin.

Suitable solvents for use in the practice of this invention are those which are of the hydrogen-donor type and are at least partially hydrogenated and include naphthalenic hydrocarbons. Preferably, the solvent is one which is in liquid phase at the recommended temperature and pressure for extraction. Mixtures of hydrocarbons are generally employed as the solvent and, preferably, are derived from intermediate or final products obtained from subsequent processing following the practice of this invention. A preferred solvent comprises a hydrogenated coal oil which has been hydrogenated to convert at least about 80% of the asphaltenes. Typically, the solvent hydrocarbons or mixtures of hydrocarbons boil between about 500° F. and 800° F. Examples of other suitable solvents are tetrahydronaphthalene (Tetralin), Decalin, biphenyl, methylnaphthalene, dimethylnaphthalene, etc.

Apparatus for use in pulverizing the lump or coarse coal feed to the present invention may be of any type known to those skilled in the art. Conventional ball mills or rod mills may be used with satisfactory results. Preferably, the apparatus must be able to pulverize lump or coarse coal in the presence of significant quantities of liquid solvent without difficulty. Those skilled in the art are familiar with the kinds of apparatus for processing wet solids and the crushing and grinding thereof, such that no detail discussion of the apparatus need be presented herein. The primary requirement for crushing and grinding of the lump coal is that coarse coal usually having an average particle diameter in excess of 0.08 inches and, typically, about 0.25 to 2.0 inches must be processed thereto and reduced in size to an average particle diameter which would be of at least 8 Tyler screen size and, preferably, would be reduced to an average particle size for 14 Tyler screen size. As used herein the term "Tyler screen" refers in all instances to the commercial Tyler Standard Screens.

The operation of the pulverization equipment is preferably performed so that the oversized material, that is, greater in size than the 8 Tyler screen size, be separated and returned to the apparatus for further pulverization. The utilization of the closed circuit technique is well known to those skilled in the art and is preferred in the practice of this invention. Unless otherwise stated, closed circuit operation of the pulverization equipment will be deemed inherent in the practice of this invention.

Following the size reduction step wherein the oversized solid materials have been separated from the effluent of the pulverization zone, comminuted coal is passed into a solvent extraction zone which, in effect, is a reaction zone for the substantial conversion of the coal into liquid coal extract.

The operating conditions for the solvent extraction zone include a temperature from about 400° F. to about 950° F., a pressure from about 500 to about 5,000 psig., a solvent to coal weight ratio from about 0.1 to about 10, a residence time from about 30 seconds to about 10 hours, a residual oil to coal weight ratio from about 0.01 to about 10 based on m.a.f. coal and, preferably, the presence of hydrogen sufficient to dissolve coal such that a toal in excess of 50 percent by weight of m.a.f. coal fed into the solvent extraction zone has been liquefied.

Hydrogenation in the extraction zone, generally, accomplishes the following functions: transfer of hydrogen directly to coal molecules; transfer of hydrogen to hydrogen-donor molecules; transfer of hydrogen from hydrogen-donor molecules to coal molecules; and various combinations of the above.

The catalytic conversion performed by the metal sulfide catalyst may be enhanced by the admixture of hydrogen sulfide with the hydrogen during the practice of the present invention. Hydrogen sulfide is preferably present during the contacting of the coal with hydrogen in an amount to provide a hydrogen to hydrogen sulfide molar ratio from about 2 to about 200 and more preferably from about 4 to about 100.

After separation of the gaseous materials, including hydrogen, undissolved coal residue (e.g., ash) and residual oil from the total effluent of the extraction zone, the liquid coal extract is passed into conventional recovery facilities wherein valuable liquid hydrocarbons are recovered.

Typically, these recovery facilities comprise fractionation columns for the separation therein of the liquid coal extract into products such as normally gaseous hydrocarbons, relatively light hydrocarbons comprising essentially middle distillate oil, relatively heavy hydrocarbons comprising materials suitable for use as a coal solvent and a bottoms fraction comprising residue material which is suitable for fuel. In essence, therefore, the valuable liquid hydrocarbons recovered from the liquid coal extract include, for example, gasoline boiling range products and/or chemicals, aromatic hydrocarbon-containing fractions, heavy fuel oil fractions, and the like, the utility of which is well known to those skilled in the art.

The extraction of coal by means of a selective solvent is by definition at least a partial conversion of the coal since not only is the coal reacted with hydrogen which is transferred from the solvent, but is also reacted with the hydrogen which is added during the extraction step. In addition, there is also a solution phenomenon which actually dissolves the coal which has accepted the hydrogen into the solvent. Therefore, as used herein, the terms "liquid coal extract" and "liquid coal fraction" or other words of similar import are intended to include the liquid product which is obtained from the solvent extraction of the coal with the selective solvent in the presence of the residual oil containing asphaltenes and at least one finely divided, unsupported metal sulfide and generally has been described on the basis of being "solvent-free" even though a portion of the extract comprises hydrocarbons suitable for use as the solvent.

A suitable source of residual oil containing asphaltenes and at least one finely divided, unsupported metal sulfide may be selected from a high metal content, heavy whole crude, a high metal content atmospheric tower bottoms, or a high metal content vacuum tower bottoms. A preferred high metal containing residual oil is a catalyst sludge from a slurry catalyst hydrotreatment of a high metals content hydrocarbon. The finely divided, unsupported metal sulfide is usually present in the residual oil in an amount greater than about 100 ppm by weight based on the elemental metal. A preferred range of the finely divided, unsupported metal sulfide is from about 0.01 to about 25 weight percent based on the elemental metal and on the residual oil. A more preferred range of the finely divided, unsupported metal sulfide is from about 2.0 to about 10 weight percent based on the elemental metal and on the residual oil.

In some cases where the residual oil does not contain an adequate amount of finely divided metal sulfide, additional metal sulfide may be added to the solvent extraction zone to obtain the desired results.

The finely divided, unsupported metal sulfide has a nominal diameter or particle size of at least one millimicron with a preferred range of from about one micron to about 2000 microns and with a more preferred range from about one micron to about 100 microns. The finely divided, unsupported metal sulfide may be selected from any convenient catalytic metal sulfide. Such metals may be selected from Group V-B, Group VI-B, and Group VIII of the Periodic Table. Preferred metals include vanadium, molybdenum, tungsten, iron, cobalt and nickel.

High metal content hydrocarbons are unsuitable for hydrotreating in a conventional fixed bed hydrotreater because the metals are deposited on the catalyst at a rapid rate which not only physically plugs the flow of the reactants through the reaction zone but masks the small catalytic sites. This physical plugging precludes long, uninterrupted operation of the hydrotreater which is highly disruptive of the entire processing complex of which the hydrotreater is a small but important part. The prior art describes processes which are much more adaptable to the hydrotreating of high metals hydrocarbons. In general, a facile method for hydrotreating high metals hydrocarbons is via a catalyst slurry process whereby the hydrocarbon is admixed with hydrogen and a finely divided metal catalyst or metal catalyst precursor and subjected to elevated temperature and pressure in a reaction zone. The reaction zone effluent is separated to yield a hydrotreated hydrocarbon and a catalyst sludge containing asphaltenes and at least one metal sulfide. Many of the high metals hydrocarbons which are processed in a slurry fashion contain nickel, vanadium and iron. These indigenous metals may be converted in the process to form metal sulfides which are separated from the hydrogenated hydrocarbons and may then be recycled to fresh hydrocarbon feed as a catalyst source. In some cases, where the catalyst requirements are capable of being generated from the feedsock, an initial catalyst supply may be added to the process during start-up. In other cases where the metals level of the feedstock is too low to permit catalyst generation in sufficient quantities to sustain the process, additional metal catalyst or catalyst precursors may be added. Such metals may be selected from Group V-B, Group VI-B, and Group VIII of the Periodic Table.

A typical residual oil catalyst sludge containing asphaltenes and at least one finely divided, unsupported metal sulfide which was a drag stream from a high metal hydrocarbon conversion process contained 1.4 weight percent vanadium, 0.12 weight percent nickel, 59.3 weight percent asphaltenes (defined as heptane insolubles) and 7.32 weight percent toluene insolubles.

The following examples are given to illustrate the process of the present invention and the effectiveness thereof in converting coal into liquid hydrocarbons. It is not intended that the present invention be unduly limited by the examples presented.

EXAMPLE I

In this example, and those that follow, the experiments were conducted batch-wise in a rocker autoclave with a capacity of 1800 cc. This example demonstrates the results achieved by reaction of coal with a residual oil catalyst sludge containing asphaltenes and a finely divided vanadium sulfide, but without a solvent, contrary to the process of the present invention.

A fifty gram sample of finely divided Illinois No. 6 coal having the characteristics presented in Table I was charged to the autoclave together with 50 grams of a residual oil catalyst sludge containing asphaltenes and a finely divided vanadium sulfide having the characteristics presented in Table II. The autoclave was then pressured with a 10/90 hydrogen sulfide-hydrogen molar mixture to about 750 psig and then pressured with pure hydrogen to about 1500 psig. The charged autoclave was then heated to a temperature of about 735° F. and maintained at a pressure of about 2500 psig for one hour. The cooled contents of the autoclave were recovered and extracted with toluene to produce a liquid product and a toluene insoluble fraction containing vanadium sulfide, ash and unconverted coal. The toluene extracted fraction was then stripped of toluene to yield a coal liquid product. The coal liquid product weighed 81.8 grams and contained 56.6 weight percent heptane insolubles, 5.55 weight percent toluene insolubles, 86.48 weight percent carbon, 8.32 weight percent hydrogen, 2.19 weight percent sulfur and 1.12 weight percent nitrogen. Recovery was also made of 7.5 grams of water, and 4.5 grams of hydrocarbon gas. The unconverted coal was 4.2 weight percent based on the m.a.f. coal feed. The catalyst sludge and the liquid product contained 26.4 grams and 46.3 grams of heptane insolubles, respectively, while the ratio of heptane insolubles in the liquid product to heptane insolubles in the charge, excluding coal, was 1.75. The results from this example as well as the following examples are included in Table III. From the results of this experiment, this technique is undesirable for the maximum production of high quality liquid hydrocarbons from coal.

EXAMPLE II

A one hundred gram sample of finely divided Illinois No. 6 coal having the characteristics presented in Table I was charged to the autoclave together with, in accordance with the process of the present invention, 100 grams of a catalyst sludge containing asphaltenes, a finely divided vanadium sulfide having the characteristics presented in Table II, and 106.5 grams of a coal liquefaction derived full boiling material acting as a coal solvent and more fully described and characterized in Table IV. 10.1 grams of finely divided vanadium sulfide were added to the reaction mixture to effect simulation of a catalyst sludge having a total elemental vanadium content of 4.28 wt %. The autoclave was then pressured with a 10/90 hydrogen sulfide-hydrogen molar mixture to about 750 psig and then pressured with pure hydrogen to about 1500 psig. The charged autoclave was then heated to a temperature of about 735° F. and maintained at a pressure of about 2500 psig for one hour. The cooled contents of the autoclave were recovered and extracted with toluene to produce a liquid product and a toluene insoluble fraction containing ash, unconverted coal and vanadium sulfide. The toluene extracted fraction was then stripped of toluene to yield a coal liquid product which weighed 266 grams and contained 9.86 weight percent heptane insolubles, 1.69 weight percent toluene insolubles, 87.38 weight percent carbon, 8.58 weight percent hydrogen, and 1.35 weight percent sulfur. Recovery was also made of 18.5 grams of water and 4.4 grams of hydrocarbon gas. The unconverted coal was 3.9 weight percent based on the m.a.f. coal feed. The catalyst sludge, the solvent, and the liquid product contained 52.8 grams, 7.5 grams and 26.2 grams of heptane insolubles, respectively, while the ratio of heptane insolubles in the liquid product to heptane insolubles in the charge, excluding coal, was 0.43.

This example represents the preferred embodiment of the present invention and demonstrates the production of high quality liquid hydrocarbons from coal and with excellent yields.

EXAMPLE III

A one hundred gram sample of finely divided Illinois No. 6 coal having the characteristics presented in Table I was charged to the autoclave together with 100 grams of catalyst sludge containing asphaltenes and a finely divided vanadium sulfide having the characteristics presented in Table II and 10.4 grams of finely divided vanadium sulfide. The autoclave was then pressured with a 10/90 hydrogen sulfidehydrogen molar mixture to about 750 psig and then pressured with pure hydrogen to about 1500 psig. The charged autoclave was then heated to a temperature of about 735° F. and maintained at a pressure of about 2500 psig for one hour. The cooled contents of the autoclave were recovered and extracted with toluene to produce a liquid product and a toluene insoluble fraction containing ash, unconverted coal and vanadium sulfide. The toluene extracted fraction was then stripped of toluene to yield a coal liquid product which weighed 159.8 grams and contained 35.7 weight percent heptane insolubles. Recovery was also made of 16.0 grams of water. The unconverted coal was 3.9 weight percent based on m.a.f. coal feed. The catalyst sludge and the liquid product contained 52.8 grams and 59.0 grams of heptane insolubles, respectively, while the ratio of heptane insolubles in the liquid product to heptane insolubles is the charge, excluding coal, was 1.08.

This experiment was performed without the utilization of a solvent and the results are inferior to those in Example II in that the actual conversion of coal was lower and the elimination of heptane insolubles was less.

EXAMPLE IV

A one hundred gram sample of finely divided Illinois No. 6 coal having the characteristics presented in Table I was charged to the autoclave together with 100 grams of a catalyst sludge containing asphaltenes and a finely divided vanadium sulfide having the characteristics presented in Table II, and 100.8 grams of a coal derived full boiling material acting as a coal solvent and more fully described and characterized in Table IV.

It is to be noted in this experiment that no finely divided vanadium sulfide was added to supplement the vanadium present in the above-mentioned catalyst sludge and, therefore, the vanadium content in the reaction mixture was less than the most preferred range of from 2 wt.% to 10 wt.% based on the weight of sludge. The autoclave was pressured with a 10/90 hydrogen sulfide-hydrogen molar mixture to about 750 psig and then pressured with pure hydrogen to about 1500 psig. The charged autoclave was then heated to a temperature of about 735° F. and maintained at a pressure of about 2500 psig for one hour. The cooled contents of the autoclave were recovered and extracted with toluene to produce a liquid product and a toluene insoluble fraction containing ash, unconverted coal and vanadium sulfide. The toluene extracted fraction was then stripped of toluene to yield a coal liquid product which weighed 261.9 grams and contained 15.7 weight percent heptane insolubles. Recovery was also made of 3 grams of water and 3 grams of hydrocarbon gas. The unconverted coal was 6.4 weight percent based on the m.a.f. coal feed. The catalyst sludge, the solvent and the liquid product contained 52.8 grams, 4.3 grams and 41.1 grams, respectively, while the ratio of heptane insolubles in the liquid product to heptane insolubles in the charge, excluding coal was 0.72.

In this experiment, it appears that the conversion of heptane insolubles in the liquid product was reduced by the lesser quantity of vanadium catalyst available to the system.

EXAMPLE V

A one hundred gram sample of finely divided Illinois No. 6 coal having the characteristics presented in Table I was charged to the autoclave together with 150 grams of a coal derived full boiling range material acting as a coal solvent and described in Table IV. This experiment was conducted, contrary to the process of the present invention, in the absence of a finely divided metal sulfide, i.e. there was neither catalyst sludge containing vanadium nor any additional finely divided vanadium sulfide. The autoclave was then pressured with a 10/90 hydrogen sulfide-hydrogen molar mixture to about 750 psig and then pressured with pure hydrogen to about 1500 psig. The charged autoclave was then heated to a temperature of about 735° F. and maintained at a pressure of about 2500 psig for one hour. The cooled contents of the autoclave were recovered and extracted with toluene to produce a liquid product and a toluene insoluble fraction containing ash and unconverted coal. The toluene extracted fraction was then stripped of toluene to yield a coal liquid product which weighed 200.3 grams and contained 22.6 weight percent heptane insolubles.

The most important fact in this experiment is that 13.2 weight percent of the coal remained unconverted which is substantially inferior to the coal conversion demonstrated according to the preferred embodiment of this invention and illustrated in Example II.

From the foregoing description and examples, it is apparent that the process of the present invention provides a superior method for the production of high quality liquid petroleum substitutes from coal.

TABLE I

| ANALYSIS OF ILLINOIS NO. 6 COAL | |
|---|---|
| Carbon, wt. % | 70.05 |
| Hydrogen, wt. % | 5.88 |
| Oxygen, wt. % | 9.01 |
| Sulfur, wt. % | 2.68 |
| Nitrogen, wt. % | 1.20 |
| Ash, wt. % | 9.02 |
| Moisture (Water), wt. % | 2.15 |

TABLE II

| ANALYSIS OF CATALYST SLUDGE | |
|---|---|
| Vanadium, wt. % | 1.40 |
| Nickel, wt. % | 0.12 |
| Heptane Insolubles, wt. % | 59.3 |
| Toluene Insolubles, wt. % | 7.32 |
| Viscosity, Centistokes at 450° F. | 1300 |

TABLE III

COAL LIQUEFACTION SUMMARY

| EXAMPLE | I | II | III | IV | V |
|---|---|---|---|---|---|
| COAL FEED, grams | 50 | 100 | 100 | 100 | 100 |
| CATALYST SLUDGE, grams | 50 | 100 | 100 | 100 | |
| SOLVENT, grams | — | 106.5 | — | 100.8 | 150 |
| ADDITIONAL CATALYST, grams of $VS_4$ | — | 10.1 | 10.4 | — | |
| LIQUID PRODUCT, grams | 81.8 | 266 | 159.8 | 261.9 | 200.3 |
| HEPTANE INSOLUBLES, WT. % | 56.6 | 9.86 | 35.7 | 15.7 | 22.6 |
| TOLUENE INSOLUBLES, WT. % | 5.55 | 1.69 | 3.59 | 2.32 | 4.20 |
| INSOLUBLES, grams | 6.6 | 17.7 | 21.1 | 20.0 | 23.4 |
| CARBON, WT. % | 25.71 | 17.98 | 19.3 | 26.04 | 46.85 |
| HYDROGEN, WT. % | 2.32 | 1.78 | 2.19 | 2.60 | 3.41 |
| WATER, grams | 7.5 | 18.5 | 16.0 | 3.0 | 13.0 |
| HYDROCARBON GAS, grams | 4.5 | 4.4 | 5.0 | 3.0 | — |
| UNCONVERTED COAL, WT. % MAF | 4.2 | 3.9 | 5.1 | 6.4 | 13.2 |
| HEPTANE INSOLUBLES CHARGED, grams | | | | | |
| CATALYST SLUDGE | 26.4 | 52.8 | 52.8 | 52.8 | |
| SOLVENT | — | 7.5 | — | 4.3 | |
| HEPTANE INSOLUBLES IN LIQUID PRODUCTS, grams | 46.3 | 26.2 | 59.0 | 41.1 | |

TABLE III-continued

| COAL LIQUEFACTION SUMMARY | | | | | |
|---|---|---|---|---|---|
| EXAMPLE | I | II | III | IV | V |
| HEPTANE INSOLUBLES RATIO (LIQUID PRODUCT/ CHARGE) | 1.75 | 0.43 | 1.08 | 0.72 | |

TABLE IV

| COAL DERIVED SOLVENT | |
|---|---|
| API Gravity at 60° F. | 5.5 |
| Distillation, °F. | |
| IBP, | 360 |
| 20% | 538 |
| 50% | 672 |
| 70% | 822 |
| 82% | 1000 |
| SUS Viscosity at 210° F. | 59.4 |

I claim:

1. A process for producing hydrogen-enriched hydrocarbonaceous products from coal which comprises:

(a) contacting said coal in a solvent extraction zone at solvent extraction conditions with a solvent, hydrogen and a residual oil containing asphaltenes and at least one finely divided, unsupported metal sulfide; and (b) recovering hydrogen-enriched hydrocarbonaceous products.

2. The process of claim 1 wherein said residual oil is atmospheric crude tower bottoms.

3. The process of claim 1 wherein said residual oil is vacuum tower bottoms.

4. The process of claim 1 wherein said residual oil is a catalyst sludge.

5. The process of claim 4 wherein said catalyst sludge is obtained from a slurry catalyst process which hydrotreats a high metals content hydrocarbon.

6. The process of claim 1 wherein said solvent extraction conditions include a temperature from about 400° F. to about 900° F., a pressure from about 500 to about 5,000 psig, a solvent to coal weight ratio from about 0.1 to about 10 and a residence time from about 30 seconds to about 10 hours.

7. The process of claim 1 wherein the residual oil to coal weight ratio is from about 0.01 to about 10.

8. The process of claim 1 wherein said residual oil contains from about 0.01 to about 20 weight percent metal based on the elemental metal.

9. The process of claim 1 wherein said residual oil contains from about 2.0 to about 10 weight percent metal based on the elemental metal.

10. The process of claim 1 wherein said metal is a Group V-B metal.

11. The process of claim 1 wherein said metal is a Group VI-B metal.

12. The process of claim 1 wherein said metal is a Group VIII metal.

13. The process of claim 1 wherein said Group V-B metal is vanadium.

14. The process of claim 1 wherein said Group VI-B metal is molybdenum.

15. The process of claim 1 wherein said Group VIII metal is nickel.

16. The process of claim 1 wherein said solvent comprises hydrocarbons previously derived from coal liquefaction.

17. The process of claim 1 wherein said solvent comprises naphthalenic hydrocarbons.

18. The process of claim 1 wherein the finely divided, unsupported metal sulfide has a nominal diameter from about one micron to about 2000 microns.

19. The process of claim 1 wherein said solvent comprises a hydrogenated coal oil which has been hydrogenated to convert at least about 80% of the asphaltenes.

20. The process of claim 1 wherein said hydrogen is admixed with hydrogen sulfide in an amount to provide a hydrogen to hydrogen sulfide molar ratio of from about 2 to about 200.

21. The process of claim 1 wherein said hydrogen is admixed with hydrogen sulfide in an amount to provide a hydrogen to hydrogen sulfide molar ratio of from about 4 to about 100.

* * * * *